US006857993B2

(12) United States Patent
Yeh

(10) Patent No.: US 6,857,993 B2
(45) Date of Patent: Feb. 22, 2005

(54) MAGNETIC TENSION CONTROL WEIGHT TRAINING MACHINE

(76) Inventor: Yong-Song Yeh, 5F-23, 70, Fu-Hsing Road, Taoyuan (TW)

( * ) Notice: Subject to any disclaimer, the term of this patent is extended or adjusted under 35 U.S.C. 154(b) by 0 days.

(21) Appl. No.: 10/617,382

(22) Filed: Jul. 11, 2003

(65) Prior Publication Data

US 2005/0009672 A1 Jan. 13, 2005

(51) Int. Cl.[7] ..... A63B 21/00; A63B 69/06
(52) U.S. Cl. ..... 482/92; 482/93; 482/51
(58) Field of Search ..... 482/51–53, 91–92, 482/4–10, 138, 903, 57–65, 70

(56) References Cited

U.S. PATENT DOCUMENTS 4,261,562 A * 4/1981 Flavell ..... 482/6
4,822,032 A * 4/1989 Whitmore et al. ..... 482/63
6,071,215 A * 6/2000 Raffo et al. ..... 482/57
6,599,223 B2 * 7/2003 Wang et al. ..... 482/138

* cited by examiner

*Primary Examiner*—Stephen R. Crow
(74) *Attorney, Agent, or Firm*—Troxell Law Office, PLLC

(57) ABSTRACT

The present invention relates to a magnetic tension control weight training machine containing a base, large revolver wheel, belt disc, shaft set, bearing assembly, pulley assembly, magnetic resistance flywheel, pulling rope and a reposition device. A wheel spacer is welded to the center of the large revolver wheel within which there is a bearing assembly, on one side fixed with a small revolver wheel for reposition. The shaft set fits through the bearing assembly, one end welded with a shaft disc to fasten the belt disc that is connected with the magnetic resistance flywheel and the large revolver wheel by means of the belt. The size of the small revolver wheel and the active pulley makes the extension length of the flexible components quite short. The reposition device adjusts the reposition course through the active pulley and the adjustment bolt, allowing for the control of the force.

4 Claims, 6 Drawing Sheets

MAGNETIC TENSION CONTROL WEIGHT TRAINING MACHINE

FIELD OF THE INVENTION

The present invention relates to a magnetic tension control weight training machine that provides multiple body-building exercises such as rowing training and physical strength training.

BACKGROUND OF THE INVENTION

Traditional tension control weight training machine only provides a single function, either hand/feet training or extension training. In order to make the weight training machine as small as possible for the purpose of convenience, the weight training machine is usually made quite simple in its mechanical structures with load-bearing structure and the flexible spiral spring. Such a spring, however, loses its flexibility after a while, making it unable to reposition the pulling rope back to the original place. When the force enact on the machine terminates, a strong back pulling force occurs that applies on the user when the rope is on its way back to the start point.

SUMMARY OF THE INVENTION

The main objective for the present invention is to provide a magnetic tension control weight training machine with a precise control over the resistance force through a large revolver wheel that rotates toward a specific direction. With an accurate reposition device, the magnetic tension control weight training machine can provide the best training effects.

In the following, the embodiment illustrated is used to describe the detailed structural characteristics and operation action for the present invention.

DETAILED DESCRIPTION OF THE INVENTION

Figure 1:
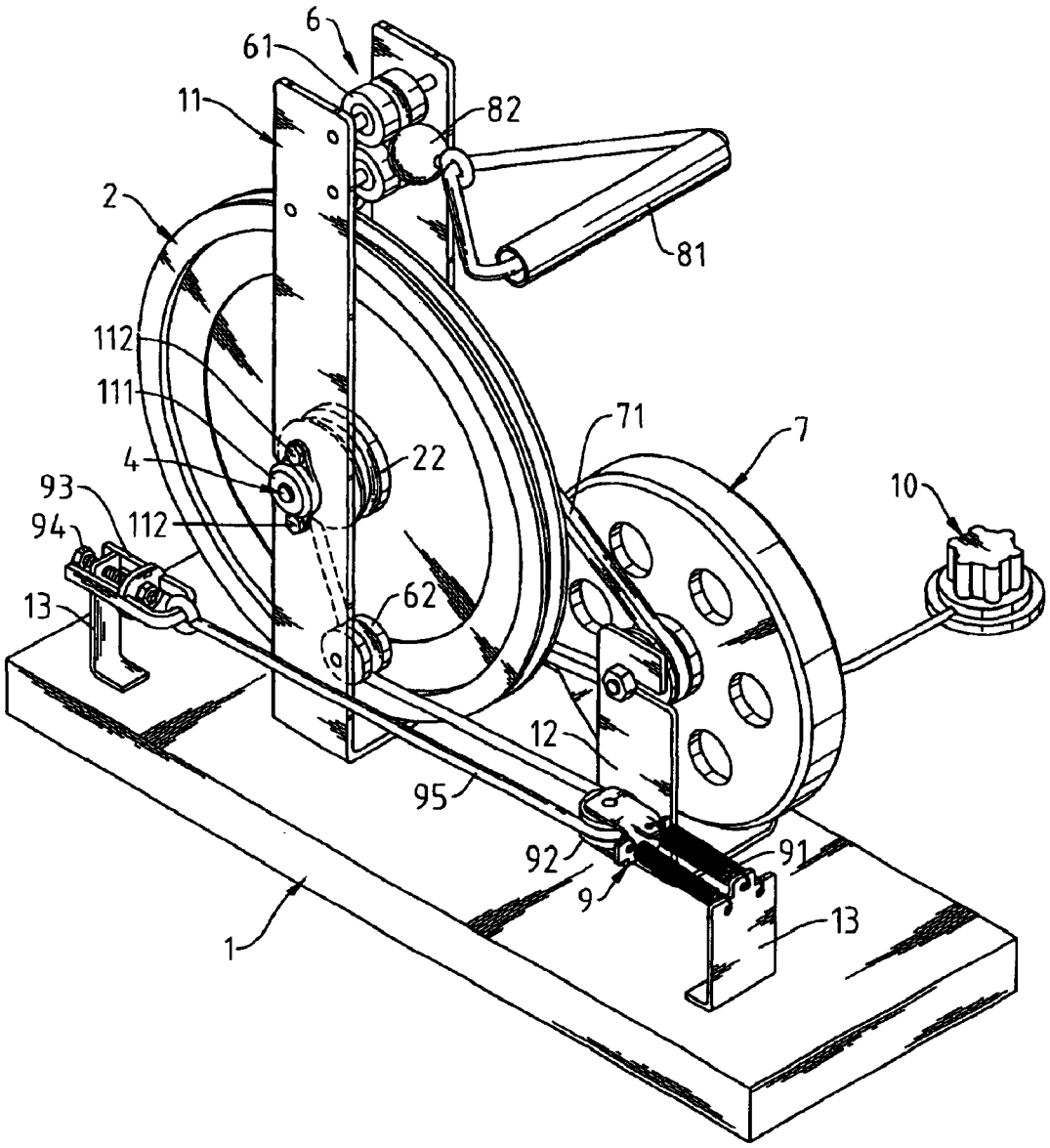
FIG. 1 is a three-dimensional illustration for the outlook of the present invention.
Figure 2:
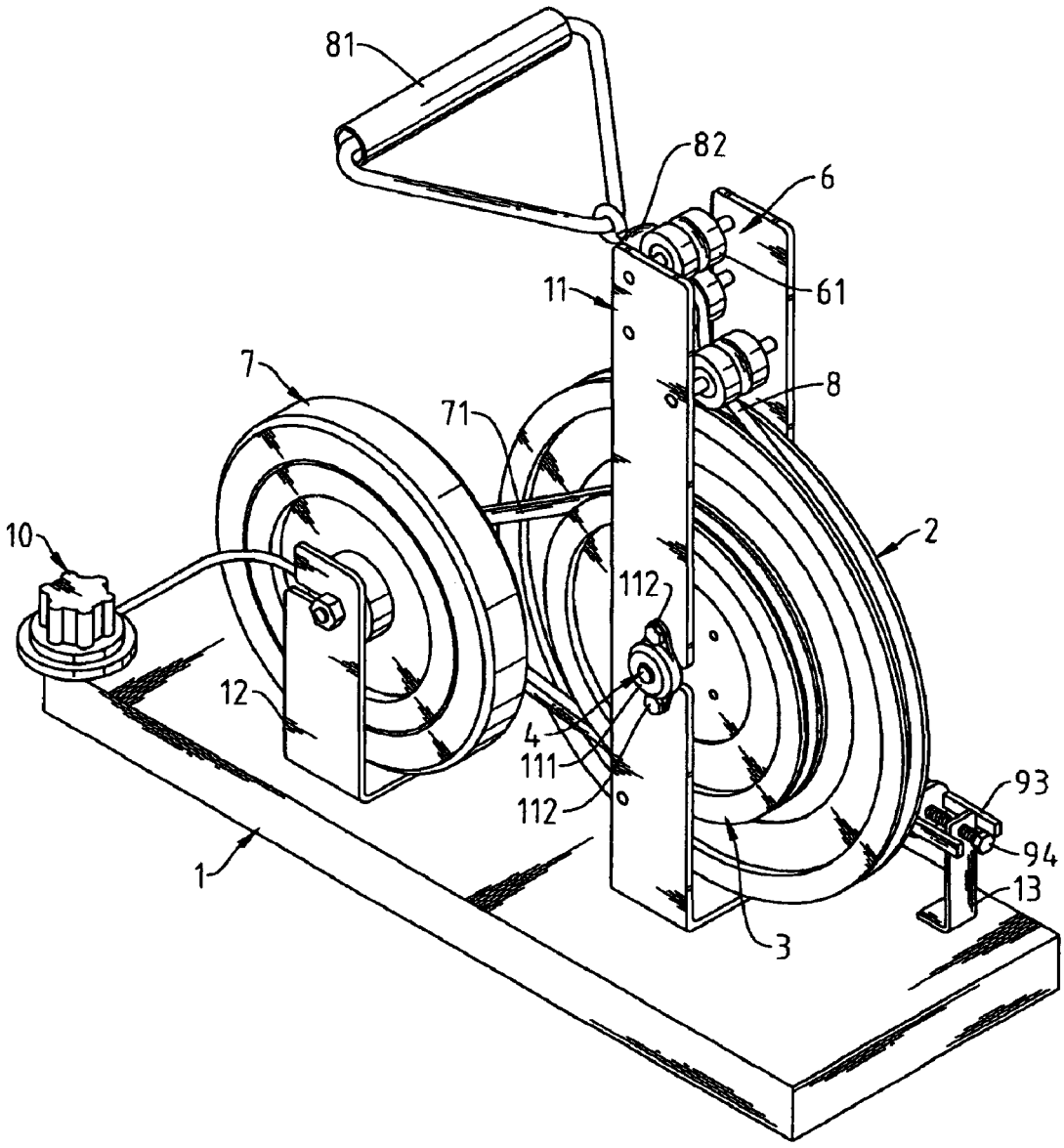
FIG. 2 is a three-dimensional illustration for the outlook from another angle of the present invention.
Figure 3:
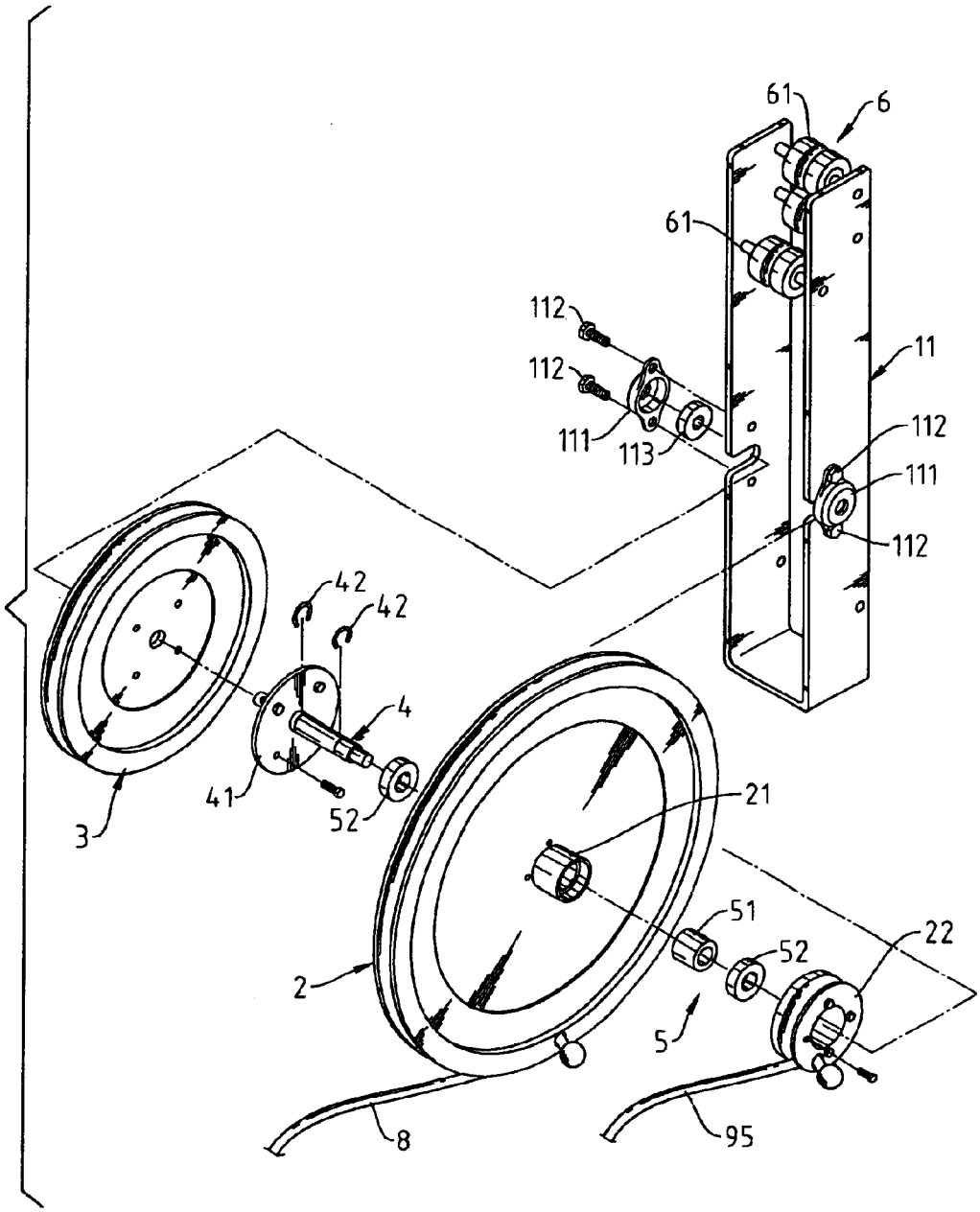
FIG. 3 is a three-dimensional illustration for deformation of the present invention.
Figure 4:
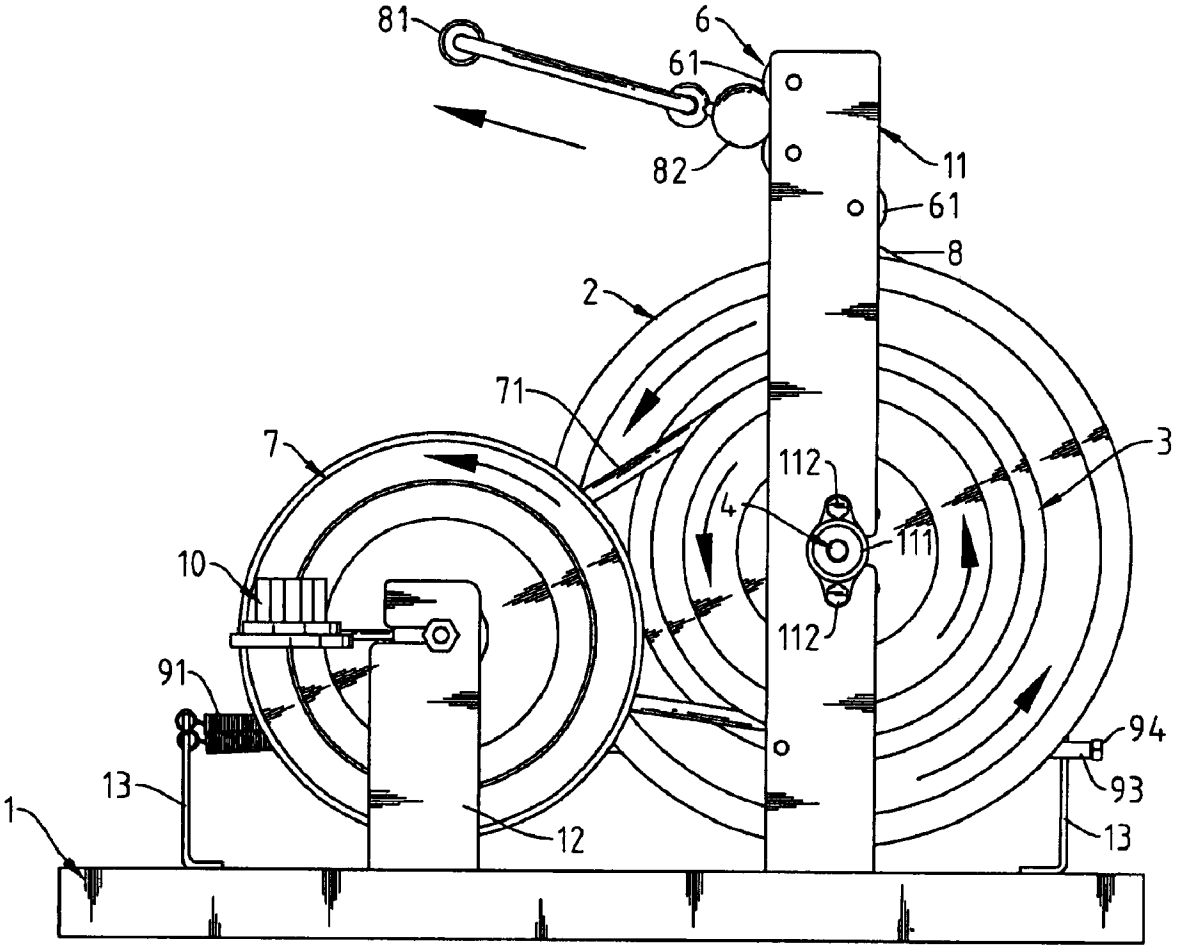
FIG. 4 is an end view for the application of the present invention.
Figure 5:
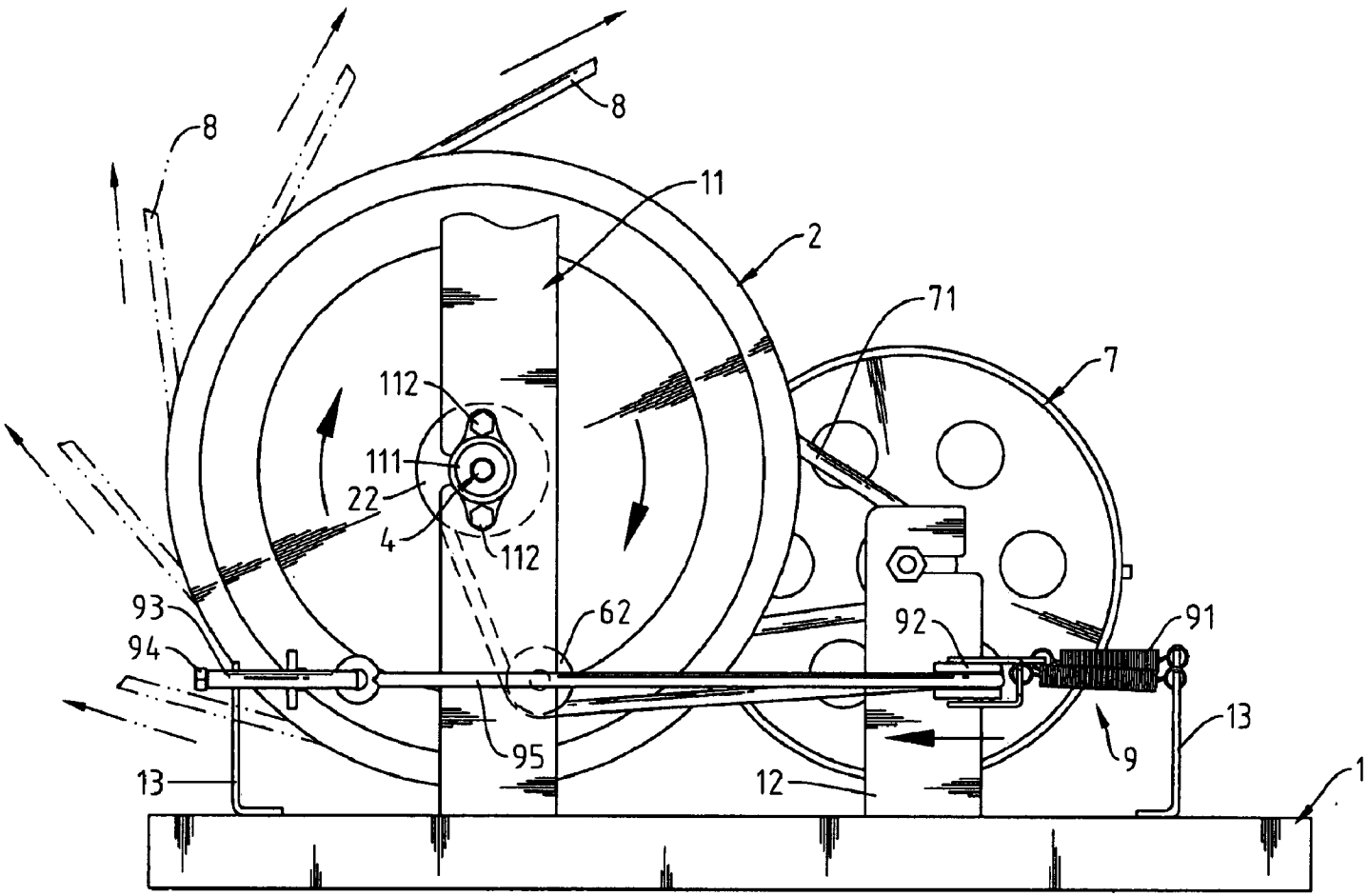
FIG. 5 is an end view for another application of the present invention.

Please refer to FIG. 1 to FIG. 3. The magnetic tension control weight training machine mainly contains a base 1, a large revolver wheel 2, a belt disc 3, a shaft set 4, a bearing assembly 5, a pulley assembly 6, a magnetic resistance flywheel 7, a pulling rope 8 and a reposition device 9. Two braces 11, 12 are fixed upon the base 1, where the brace 11, 12 allows for the placement of the large revolver wheel 2 and the magnetic resistance flywheel 7 and other components, specifically, the brace 11 is for the placement of the large revolver wheel 2, the belt disc 3, the shaft set 4, the bearing assembly 5 and the pulley assembly 6. The wheel spacer 21 of the large revolver wheel 2 contains the bearing assembly

5 wherein there is one way bearing 51 and two other bearings 52. The other two bearings 52 could be metallic bushings, the mechanism of one way bearing can prevents the large revolver wheel 2 from being unintentionally rotated reversibly after in motion of revolving.

The shaft set 4 passes through the bearing assembly 5 inside the large revolver wheel 2, with its snap ring 42 locking up the bearing assembly 5. There is a small revolver wheel 22 place on one side of the large revolver wheel on the wheel spacer 21. Slipped onto the wheel spacer 21, the small revolver wheel 22 is fixed on the large revolver wheel 2. On the shaft set 4 protruding out from the large revolver wheel 2 there is a shaft disc 41 fixed to the belt disc 3. With the shaft set 4 passing through the large revolver wheel 2, the large revolver wheel 2 is connected to the belt disc 3. After assembling the above components through the shaft set 4, the ends of the shaft set 4 are put on the brace 11. The mounting part of the shaft set's 4 ends could be locked with bearings 113 in the flanged housings 111 and tighten with bolts 112.

After placing the large revolver wheel on the brace 11, the pulley assembly 6 for the application of the pulling rope 8 is placed above the large revolver wheel 2. The pulley assembly 6 has several pulleys 61. One end of the pulling rope 8 is fixed on the tip of the large revolver wheel 2 while the other end passes through the pulley assembly 6, connecting the pulling handle 81. The stop ball 82 beneath the pulling handle 81 limits the pulling rope 8 in-between the pulley assembly 6.

After the large revolver wheel 2 is set, the magnetic resistance flywheel 7 is place on the brace 12 which is on the same side with the belt disc 3, The magnetic resistance flywheel 7 will uses a belt 71 to connect with the belt disc 3, so as to revolve the magnetic resistance flywheel 7 through the rotation of the large revolver wheel 2.

For the connection of the large revolver wheel 2 and the reposition device 9, the pulling rope 95 connects the reposition device 9 with the small revolver wheel 22 of the large revolver wheel 2. On the external side of the brace 11 (that is on the same side of the small revolver wheel 22) designed for the placement of the large revolver wheel 2 there are two flex fixtures 13, designed for the placement of the reposition device 9. One flex fixture 13 holds an adjustment bolt 94 which is locked with a bracket 93. The purpose of the bracket 93 is to prevent the pulling rope 95 from swaying during operation. The other flex fixture 13 has several flexible components 91 connected to an active pulley 92. A bracket 93 is used in-between the two flex fixtures 13 to fix one end of the pulling rope 95. The other end of the pulling rope 95 stretching through the active pulley 92 and entwines around the carriage pulley 62 on the brace 11 and fixes on the small revolver wheel 22.

Figure 6:
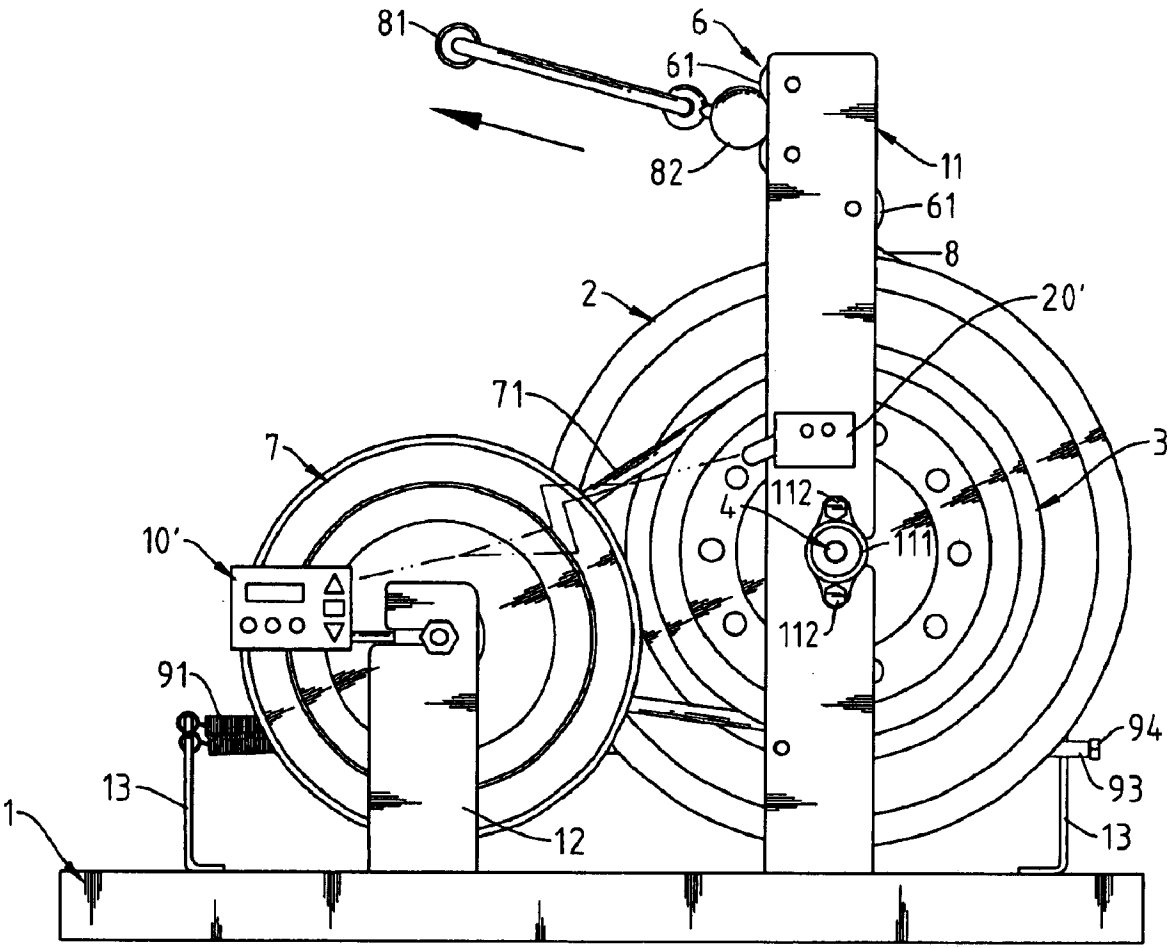
FIG. 6 is an end view for still another application of the present invention.

Please refer to FIG. 1, FIG. 2, FIG. 4 and FIG. 5. During the operation of the magnetic tension control weight training machine for the present invention, the controller 10 can adjust the control of the magnetic resistance flywheel 7. The controller might be an electronic controller 10' with a sensor 20' (refer to FIG. 6). When the pulling rope 8 is pulled, the large revolver wheel 2 rotates, driving the small revolver wheel 22 to pull the pulling rope 95 of the reposition device 9. Since the bearing assembly 5 inside the large revolver wheel 2 only rotates toward single direction, the large revolver wheel 2 driven by the pulling rope 8 wouldn't reposition on its own, but through the small revolver wheel 22 being pulled back by the pulling rope 95 and the reposition device 9 to bring the large revolver wheel 2 back to the original position. The reposition is completed by the several flexible components 91 of the reposition device 9, no need for using single large-diameter flexible component; therefore, the deformation problem is eliminated and that performs better reposition. There wouldn't be a problem for inaccurate reposition of the large revolver wheel 2 and thus influences the reposition of the pulling rope 8.

Meanwhile, the magnetic tension control weight training machine for the present invention applies to many kinds of body-building machines; therefore, the pulling rope 8 on the large revolver wheel 2 can be designed for different kinds of devices.

The present invention also provides a reposition system different from other magnetic tension control system, able to control manually or through programs. For the present invention, the ability of using automatic programs to control the magnetic tension control weight training machine because of limitation from different types of structure no longer exists. The magnetic tension control weight training machine for the present invention can replace the weight system for current physical strength training and provide multiple functions.

To summarize the above description, the power cord in the present invention can provide effective performance and extend its life of usage through a simple mechanical innovation, which practically meets the qualifications for invention based on new type and improvement. Accordingly, an application is submitted for examination.

What is claimed is:

1. A magnetic tension control training machine comprising: a base; a large revolver wheel; a belt disc; a shaft set; bearing assembly; pulley assembly; a magnetic resistance flywheel; a first pulling rope; and a reposition device, wherein said base has first and second braces, said large revolver wheel is connected to said first brace, and said magnetic resistance flywheel is connected to said second brace, said magnetic resistance flywheel is connected to said belt disc by a belt, said large revolver wheel is connected to said belt disc and drives said magnetic resistance flywheel, said belt disc, said bearing assembly, said shaft set and said pulley assembly are located on the first brace said pulley assembly for said first pulling rope is located above said large revolver wheel, the bearing assembly having a one-way bearing and two second bearings are located in a wheel spacer of said large revolver wheel, the shaft set is inserted through the wheel spacer and the bearing assembly, a shaft disc of the shaft set is connected to the belt disc, and a small revolver wheel is connected to said large revolver wheel, said reposition device is located on first and second flex fixtures and connected to said small revolver wheel, the first flex fixture has an adjustment bolt connected to a bracket and the second flex fixture has a plurality of flexible components connected to an active pulley, said bracket is connected to a first end of a second pulling rope, said second pulling rope extending through said active pulley and around a carriage pulley, and a second end of said second pulling rope is connected to said small revolver wheel; when said first pulling rope is extended said large revolver wheel is rotated and said one-way bearing inside said large revolver wheel makes said small revolver wheel pull on said second pulling rope and extend the plurality of flexible components, when the first pulling rope is retracted, the plurality of flexible components pull on said second pulling rope to return said large revolver wheel back to an original position.

2. The magnetic tension control weight training machine of claim 1, wherein said shaft set has a snap ring to position said bearing assembly.

3. The magnetic tension control weight training machine of claim 1, further comprising two flanged housings, each of the two flanged housings connecting one of two opposing ends of said shaft set to said first brace.

4. The magnetic tension control weight training machine of claim 1, wherein said two second bearings are metallic bushings.

* * * * *